US006205091B1

(12) United States Patent
Rudolph et al.

(10) Patent No.: US 6,205,091 B1
(45) Date of Patent: Mar. 20, 2001

(54) METHOD AND APPARATUS FOR CONTROLLING A SOLAR-POWERED RADIO-CONTROLLED TIMEPIECE WHEN A STORAGE ELEMENT IS INADEQUATELY CHARGED

(75) Inventors: Holger Rudolph, Eschbronn-Locherhol; Thomas Lechner, Tennenbronn; Johannes Neudecker, Bonn, all of (DE)

(73) Assignee: Junghans Uhren GmbH, Schramberg (DE)

( * ) Notice: Subject to any disclaimer, the term of this patent is extended or adjusted under 35 U.S.C. 154(b) by 0 days.

(21) Appl. No.: 09/174,097

(22) Filed: Oct. 16, 1998

(30) Foreign Application Priority Data

Oct. 17, 1997 (DE) ..... 297 18 454 U

(51) Int. Cl.[7] ..... G04B 1/00
(52) U.S. Cl. ..... 368/205; 368/47
(58) Field of Search ..... 368/203–205, 368/47

(56) References Cited

U.S. PATENT DOCUMENTS 4,023,344 * 5/1977 Mukaiyama ..... 368/47
4,582,434 * 4/1986 Plangger et al. ..... 368/46
4,650,344 3/1987 Allgaier et al. .
4,714,352 12/1987 Ganter .
5,105,396 * 4/1992 Ganter et al. ..... 368/47
5,231,612 7/1993 Allgaier et al. .
5,835,457 * 11/1998 Nakajima ..... 368/204

FOREIGN PATENT DOCUMENTS

3524290 * 1/1987 (DE) .

* cited by examiner

*Primary Examiner*—Bernard Roskoski
(74) *Attorney, Agent, or Firm*—Burns, Doane, Swecker & Mathis, LLP

(57) ABSTRACT

In a solar-powered, radio-controlled timepiece an incorrect display can occur before the operating voltage definitively falls below the switch-off level if each pulse for the electromechanical transducer is no longer sufficient for advancing the display. A step monitor senses such an insufficient pulse and triggers a reset command in order to switch on the radio signal receiver for automatically correcting the hands position to the absolute time which is decoded from the current time telegram.

7 Claims, 2 Drawing Sheets

METHOD AND APPARATUS FOR CONTROLLING A SOLAR-POWERED RADIO-CONTROLLED TIMEPIECE WHEN A STORAGE ELEMENT IS INADEQUATELY CHARGED

BACKGROUND OF THE INVENTION

The invention concerns a solar-powered radio-controlled timepiece wherein an energy storage means provides energy for operating a transducer of a time display.

A radio-controlled timepiece of that kind is known from U.S. Pat. No. 4,714,352 (corresponding to EP-A-0 208 986). That publication describes interrogation of the energy storage means for the photovoltaically generated electrical charges in respect of two different levels so that, with a rising stored voltage, at the commencement of operation, initially only the consumers or loads which are necessary for the start-up procedure are set in operation. The other consumers or loads are only switched on when the storage means has reached a higher energy level as a result of further recharging. That ensures that an overload does not occur immediately at the beginning of a rise in voltage at the storage device, with the consequence of the voltage collapsing, because otherwise operation of the timepiece, which has just begun, would be immediately switched off again, without the attainment of a stable operating state.

The functions which are necessary at the commencement of operation for the attainment of a finally stable operating state for the timepiece include operation of the processor and the receiver of a radio-controlled timepiece of the general kind set forth, as is described in greater detail for example in U.S. Pat. No. 4,645,357 (corresponding to EP-B-0 180 880). Detection of the status of the hands of the radio-controlled timepiece results in automatic correction of the positions of the hands as soon as it was possible for an applicable current item of time information to be received by radio and decoded in the processor.

The user therefore does not need to perform any manipulation operations for commencing operation; as soon as there is sufficient light energy for an adequate state of charge of the storage means, the timepiece automatically starts operating and finally automatically sets itself to the correct time display.

A problem that is involved however is that towards the end of operation an initially unnoticeable and then slowly increasing incorrect hands display can occur. That is not acceptable for a radio-controlled timepiece which is advertised as the most accurate of all conceivable consumer timepieces and which enjoys a high level of market acceptance precisely because of that accuracy—as well as because of the absence of operating requirements.

Therefore the object of the present invention is to avoid such incorrect displays which occur if towards the end of operation the energy still contained in the storage means is admittedly still sufficient for the separately buffered operation of a processor for the electro-optical display control, but not for reliable operation of the electromechanical transducer for a time-keeping movement of the hands. More specifically the latter is no longer guaranteed if, with the storage means voltage having fallen to a critical level, the drive pulse for the motor movement admittedly starts, but then does not persist over its fully predetermined length but, as a result of the electrical loading of the storage means which is already almost discharged, results in temporary breakdown of the residual voltage.

The consequence of this is that neither of the at least two shorter partial pulses which occur as a result supplies sufficient energy for operation of the motor. However, the other functions which are directly initiated by the processor and which in particular are electro-optical, such as the continuing digital representation of the seconds in a display, are finally continued without disturbance so that, towards the end of operation, the actual hands position increasingly lags behind in comparison with time-derived information which is displayed in other ways, and naturally also in relation to the actual elapse of time.

No less operationally critical is the fast-motion drive phase for rapidly pivoting the hands into a given angular position (see U.S. Pat. No. 4,650,344, corresponding to EP-B-0 180 155), in particular in the course of the hands position check on the basis of the time which is communicated by radio, the checking operation being automatically initiated at the commencement of operation and then from time to time for a hands position correction movement which may be necessary. For, the high stepping speed which occurs in the correction phase of movement, with a correspondingly increased dynamic loading on the stepping motor due to the moment of inertia of the movement transmission, represents an extreme level of loading in regard to the energy source and the drive system, and for that reason now the risk of the loss of a motor step is particularly great. If a motor step is not also actually implemented with each stepping pulse (and even in the event of interrupted motor pulses), the result of the motor drive pulse counting procedure is no longer in conformity with the number of steps actually effected so that the hands are no longer rotated into the angular position that is predetermined by the required number of steps, and therefore give an incorrect display.

SUMMARY OF THE INVENTION

In accordance with the invention, the object of affording a remedy in this respect is achieved in that there is provided an operating circuit having a so-called step monitor which triggers at least a partial restart and preferably a processor reset if a drive pulse occurs which no longer contains the necessary energy content for the stepping actuation of the electromechanical transducer.

The function of the step monitor which is provided here in accordance with the invention does not therefore correspond to that of a checking and control circuit which is previously known for the purposes of minimizing the current consumption of a timepiece stepping motor and which is based on successively shortening the stepping pulse for actuation of the electro-motor transducer until it is no longer sufficient for the stepping mode of operation and is therefore increased in length again after the insertion of an energy-rich correction pulse; wherein, in accordance with the state of the art, the fact of whether a motor step was correctly effected is usually detected inductively by means of an electrodynamic circuit.

In contrast the step monitor according to the invention prevents an incorrect display insofar as at least essential parts of a radio-controlled timepiece are switched off and re-started. In that case, in particular also the receiver for obtaining a current time telegram is switched on in order then to rotate the hands into the angular position which now applies, if the stored operating voltage has hitherto not definitively fallen to such an extent that operation of the radio-controlled timepiece can no longer be in any way whatever started afresh (before the storage means is again recharged from its photovoltaic cell to over the critical voltage threshold for starting operation).

BRIEF DESCRIPTION OF THE DRAWING

Additional alternatives and developments as well as further features and advantages of the invention will be apparent from the further claims and from the description hereinafter of a preferred embodiment of the structure according to the invention, which is diagrammatically illustrated in highly abstracted form in the drawing, being restricted to what is essential. In the drawing:

DETAILED DESCRIPTION OF A PREFERRED EMBODIMENT OF THE INVENTION

Figure 1:
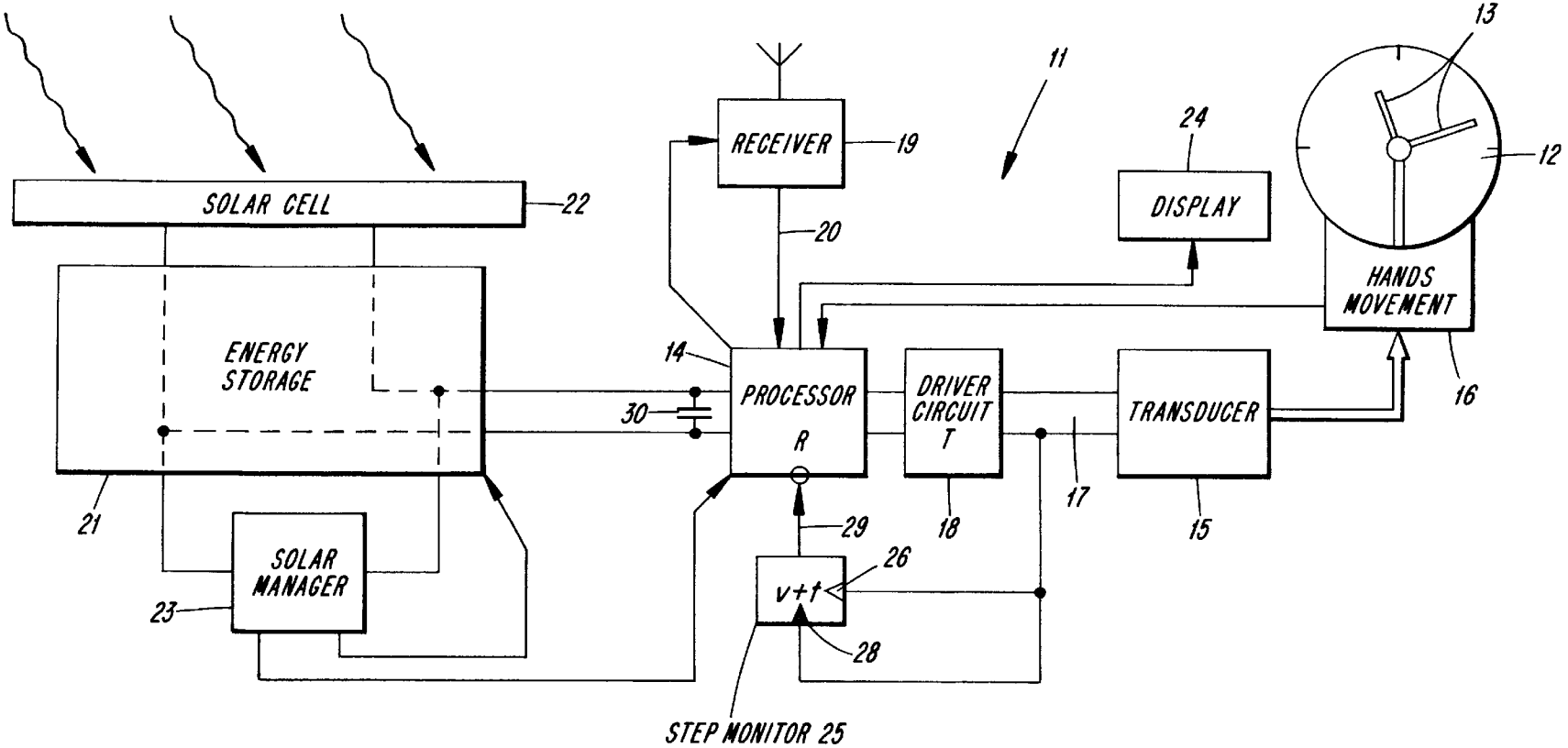
FIG. 1 shows a block circuit diagram of a solar-powered radio-controlled timepiece with an embodiment of the operating circuit according to the invention.

The solar-powered radio-controlled timepiece 11 of the kind defined in greater detail in the opening part of this specification, which is diagrammatically shown in simplified form as a block circuit diagram in FIG. 1, is provided with an electromechanical time display 12 for example in the form of digit flaps or preferably hands 13. The hands 13 are moved in a time-keeping mode from a processor 14 or a separate, preferably quartz-stabilized, timepiece circuit, by way of at least one electromechanical transducer 15, in particular a stepping motor, and the transmission wheel or gear system of the hands movement 16. Actuation of the transducer 15 with drive pulses 17 (FIG. 2*a*) is effected in the usual manner by way of a driver circuit 18 which is designed for example in the form of an active bridge network.

To provide for the monitoring procedure in respect of the time display 12, as already mentioned in the opening part of this specification, and if necessary to provide for correction thereof, the processor 14 temporarily switches on a receiver 19 at the commencement of operation and thereafter from time to time; the receiver 19 receives an item of encoded absolute time information and delivers it in the form of a demodulated telegram 20 for decoding purposes to the processor 14. The absolute time information obtained in the processor 14 by decoding is compared (also in the processor 14) to the instantaneous position of the hands 13 in order to supply the transducer 15 with correction drive pulses if necessary—that is to say in addition to the time-keeping periodicity of the regular drive pulses 17. A hands status monitoring circuit which is preferably based on interrogation by means of a light barrier assembly of given positions of gear wheels in the hands movement 16 (see U.S. Pat. No. 5,231,612, corresponding to EP-A 0 529 390) permits the processor 14 to recognize the movement of the respective hands 13 through a respective reference position and in accordance therewith also to count the drive pulses 17 which continue to occur until the hands 13 are in the correct angular position with respect to the absolute time communicated by radio.

This radio-assisted operation of the timepiece 11 is effected from a chemical or physical charge energy storage means 21 which is recharged from a photovoltaic cell 22 (popularly referred to as a solar cell). An operational control 23 which is also to be referred to as a solar manager ensures that the storage means 21 on the one hand is not overcharged from the cell 22 and on the other hand is not discharged by the consumer loads of the radio-controlled timepiece 11 to below an operationally critical voltage level. In this connection the operational control 23 can also perform the function of switching only the functionally essential consumer loads to the storage means 21 at the beginning of operation by way of the processor 14 so that the voltage of the storage means 21, which has not yet risen to full operational level, does not immediately fall below the operational limit as a result of a high level of loading, as is described in greater detail in EP-B 0 208 986. Also or additionally the operational control 23, in accordance with EP-B 0 285 838, may also provide that consumer loads which can be relinquished depending on the respective operating conditions involved are temporarily switched off, in order to spare the storage means 21. That concerns in particular night time, when therefore the storage means 21 is not recharged from the cell 22 in the darkness, for which reason it is possible to switch off functions which at night in any case would only be a nuisance or in practice would not be useful, such as for example an hours chime or the time display 12 of the hands 13 or in the display 24, which at night cannot in any case be read off. When then the charge situation of the storage means 21 has sufficiently improved for example after impingement of light the next morning, the block on the partial functions is removed again by the operational control 23 and in particular the receiver 19 is switched on in order to bring the position of the hands 13 into conformity again with the currently specified time, in the above-described manner.

It has been found however that there is the problem that, when the charge state of the storage means 21 has fallen greatly, that is to say just before the end of operation, incorrect positions of the hands 13 can occur, which cannot be recognized and corrected immediately but only when the hands next pass through a reference position in the hands movement 16. An incorrect display of that kind, even if it is scarcely apparent to the person fleetingly viewing it, is however not acceptable for the reputation of extreme precision of a consumer radio-controlled timepiece.

Figure 2A:
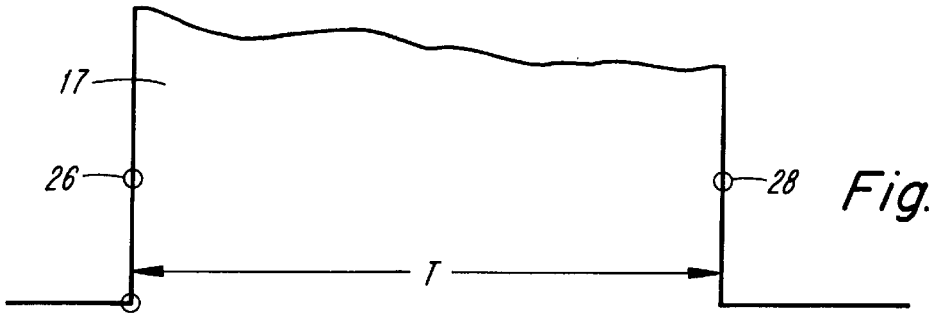
FIGS. 2*a*–2*d* show the performance characteristics of the operating circuit in dependence on the pulse shape of the motor actuation arrangement.
Figure 2B:
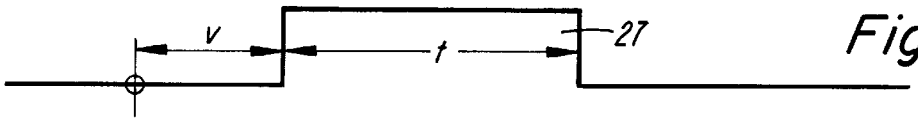
Figure 2C:
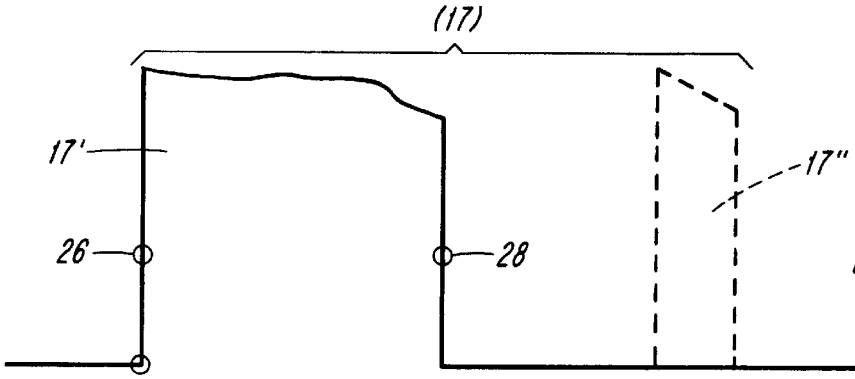

It has been found that such an incorrect display occurs by virtue of the fact that the instantaneous loading of the almost discharged storage means 21, due to a drive pulse 17 (FIG. 2*a*), temporarily results in breakdown or collapse of the storage means voltage for such a short time that admittedly the processor 14 which is provided on the operating side with a buffer 30 continues to operate uninterruptedly while however the drive pulse 17 is interrupted to afford two successive partial pulses 17' and 17" (FIG. 2*c*). Of those, one is not sufficient from the energy point of view to move the transducer 15 which is loaded by the hands movement 16, by a further step. That means that the radio-controlled timepiece 11 loses a step each time in comparison with the progressively advancing absolute time and in relation to the time information which is electro-optically displayed in the display means 24, that is to say the timepiece provides an increasingly incorrect time display. That is not acceptable, especially as the incorrect display which is initially visually scarcely discernible increases with the loss of further motor steps although the radio-controlled timepiece 11 continues to operate correctly in respect of the information which is controlled by the processor 14 (but not by way of the transducer 15).

Figure 2D:
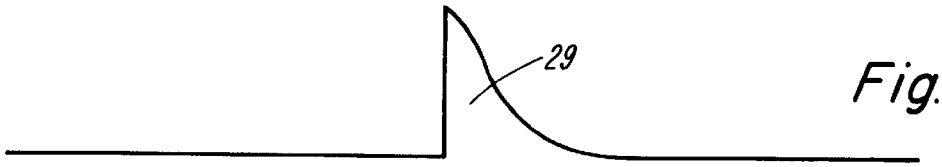

In order to bring that malfunction under control, the present invention provides a step monitor 25 which can be provided separately as diagrammatically shown in FIG. 1, or integrated in the functionality of the processor 14. That step monitor 25 is initiated by the starting or leading edge 26 of each stepping pulse 17, desirably delayed by a fixedly predetermined margin v, for the generation of a monitoring window 27 of the gate length t (with $v+t<T$ as shown in FIGS. 2*a*, 2*b*). It is terminated before the pulse duration T of the drive pulse 17 (of typically for example 8 milliseconds length with common small-size timepiece stepping motors as the transducers 15) has expired. If an end or final edge 28 occurs (FIG. 2*c*) within the window 27, that is to say before the end of the gate length t (FIG. 2*b*), then the drive pulse 17 does not have the energy content in accordance with its continuous pulse duration T (FIG. 2*a*) but it is at least interrupted—more specifically as a result of temporary breakdown or collapse of the operating voltage, that is to say as a result of instantaneously falling below the operationally necessary level at the storage means 21. Therefore neither the sum nor each individual one of the chopped pulses 17'+17" can still result in a correct stepping movement of the motor 15. In that case the step monitor 25 supplies the processor 14 with a reset command 29 (FIG. 2*d*). That results in the initiation of a restart with correction of the time displays of the radio-controlled timepiece 11 as described above, which however is actually now only implemented when the power reserve of the storage means 21 is adequate therefor. Otherwise the radio-controlled timepiece 11 remains switched off by the operational control 23 which is dependent on the storage means voltage, until the operational control initiates a fresh start again, on the basis of a sufficient charge increase in the storage means 21.

This therefore ensures that, in the event of a defective time display 12 which is due to the energy reserve having become insufficient for operation of the transducer 15, defective operation does not occur, but for display synchronization purposes the radio-controlled timepiece 11 is re-started or (with the storage means 21 discharged) is entirely switched off.

In the case of a solar-powered timepiece therefore before the operating voltage definitively falls below the switch-off level, the timepiece may suffer from an incorrect display because each pulse 17 for the electromechanical transducer 15 is no longer sufficient to advance the display as the loading due to the pulse results in an at least temporary breakdown or collapse of the operating voltage from the solar cell buffer storage means 21, which voltage has already fallen to a critical level. In accordance with the invention therefore, in a solar-powered radio-controlled timepiece 11, the interruption or curtailment, as detected by a step monitor 25, of a drive pulse 17 for the time-keeping movement of the hands, results in the triggering of a reset command 29 in order to switch on the receiver 19 of the radio-controlled timepiece 11 and thereby, by way of the radio-controlled timepiece processor control, to automatically correct the positions of the hands to the absolute time which is decoded from the current time telegram.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed:

1. A solar-powered, radio controlled timepiece comprising:

a time display;

an electromechanical transducer for stepwise driving the time display in response to a drive pulse;

a solar energy storage element for supplying power to generate the drive pulse;

a receiver for receiving radio signals representing correct time and operably connected to the transducer for correcting the time display; and a step monitor for triggering a partial restart of the timepiece. including a command for a restart of a time display correcting function in response to the absence of a drive pulse of sufficient power to properly advance the time display when the storage element is in an inadequately charged state, and for deactivating the timepiece if the inadequately charged state remains following the triggering of the restart command.

2. The timepiece according to claim 1 further comprising a processor connected between the energy storage element and the transducer, the a radio signal receiver connected to the processor, the step monitor connected to the processor for supplying thereto a reset command for resetting the operating of the time display and the radio signal receiver in response to an end edge of a drive pulse occurring prior to an expiration of a monitoring window started by the step monitor is response to a start of the drive pulse.

3. The timepiece according to claim 2 wherein the step monitor is operable to generate a monitoring window of a gate length (t) delayed by a time margin (v) in response to the start of a drive pulse having a regular pulse duration (T) when the storage element is sufficiently charged, wherein (v+t) is less than (T).

4. The timepiece according to claim 1 wherein the step monitor is operable to generate a monitoring window of a gate length (t) delayed by a time margin (v) in response to the start of a drive pulse having a regular pulse duration (T) when the storage element is sufficiently charged, wherein (v+t) is less than (T).

5. A method of operating a solar-powered, radio-controlled timepiece comprising a time display, an electromechanical step transducer for driving the time display in response to a drive pulse, and a receiver for receiving radio signals representing correct time for correcting the time display a solar energy storage element for supplying power to generate the drive pulse, the method comprising the steps of:

A) sensing an absence of a drive pulse of sufficient power to properly advance the time display;

B) triggering a partial restart of the timepiece including a command for a restart of the in response to the sensing of the absence of a drive pulse of sufficient power in step A; and C) deactivating the timepiece if the inadequately charged state remains following the triggering step.

6. The method according to claim 5 wherein the timepiece further comprises a processor connected between the energy storage element and the transducer, the receiver connected to the processor, wherein step B further comprises the steps of generating a monitoring window in response to a start of a drive pulse, and supplying to the processor a reset command for resetting the operating of the time display and the radio signal receiver in response to an end edge of the drive pulse occurring prior to an expiration of the monitoring window.

7. The method according to claim 6 wherein the monitoring window has a gate length (t) delayed by a time margin (v), the drive pulse having a regular pulse duration (T) when the storage element is properly charged, wherein (v+t) is less than (T).

* * * * *